US007246889B2

(12) United States Patent
Kanada et al.

(10) Patent No.: US 7,246,889 B2
(45) Date of Patent: Jul. 24, 2007

(54) INKJET PRINTING HEAD

(75) Inventors: Hideki Kanada, Aichi (JP); Hikoharu Aoki, Aichi (JP); Atsuo Sakaida, Gifu (JP); Kazuo Kobayashi, Gifu (JP); Yoshihumi Suzuki, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 152 days.

(21) Appl. No.: 10/874,332

(22) Filed: Jun. 24, 2004

(65) Prior Publication Data

US 2004/0263583 A1 Dec. 30, 2004

(30) Foreign Application Priority Data

Jun. 30, 2003 (JP) ..... 2003-187976

(51) Int. Cl.
*B41J 2/045* (2006.01)

(52) U.S. Cl. ..... 347/71; 347/72

(58) Field of Classification Search ..... 347/20, 347/54, 68, 70–72; 29/25.35
See application file for complete search history.

(56) References Cited

U.S. PATENT DOCUMENTS

| | | | | |
|---|---|---|---|---|
| 4,528,575 | A | 7/1985 | Matsuda et al. | |
| 4,680,595 | A * | 7/1987 | Cruz-Uribe et al. | 347/40 |
| 5,087,930 | A * | 2/1992 | Roy et al. | 347/85 |
| 5,872,583 | A * | 2/1999 | Yamamoto et al. | 347/70 |
| 5,956,059 | A | 9/1999 | Usui | |
| 6,134,761 | A | 10/2000 | Usui | |
| 6,371,601 | B1 | 4/2002 | Katakura | |
| 6,685,305 | B2 * | 2/2004 | Okuda | 347/71 |
| 2002/0175976 | A1 | 11/2002 | Okuda | |
| 2003/0112299 | A1 | 6/2003 | Kitahara | |

FOREIGN PATENT DOCUMENTS

| | | |
|---|---|---|
| EP | 1 077 331 A2 | 2/2001 |
| EP | 1 101 615 A1 | 5/2001 |
| EP | 1 356 939 A2 | 10/2003 |
| JP | U 58-147749 | 10/1983 |
| JP | A 08-169111 | 7/1996 |
| JP | A 2002-001953 | 1/2002 |

* cited by examiner

*Primary Examiner*—An H. Do
(74) *Attorney, Agent, or Firm*—Oliff & Berridge, PLC

(57) ABSTRACT

An inkjet printing head including: a common ink chamber having an outlet; and an individual ink flow path having a pressure chamber and leads ink from the outlet of the common ink chamber to a nozzle through the pressure chamber, wherein the common ink chamber and the individual ink flow path are formed of a plurality of thin plate members having holes formed thereon, the thin plate members being laminated and fixed onto one another by metal-metal junction, and wherein sectional area of the common ink chamber along a planar direction of the thin plate members is configured to be smaller at an end portion where the outlet is provided than at a central portion in a direction of thickness of the plurality of thin plate members.

15 Claims, 12 Drawing Sheets

INKJET PRINTING HEAD

BACKGROUND OF THE INVENTION

1. Field of the Invention

The present invention relates to an inkjet printing head for ejecting ink onto a recording medium to thereby perform printing.

2. Description of the Related Art

An inkjet printer includes at least one inkjet printing head having nozzles disposed therein so that ink can be ejected from the nozzles to apply printing onto a printing medium. In such an inkjet printing head, it is necessary to form complex and accurate ink flow paths in the inside of the inkjet printing head. Therefore, the inkjet printing head is formed by lamination of thin plate-like etching plates. To laminate and bond the etching plates on one another surely, for example, use of an adhesive agent such as an epoxy adhesive agent, a polyimide adhesive agent or an acrylic adhesive agent may be thought of. However, when the amount of the adhesive agent applied is large, the adhesive agent may flow into ink flow paths formed in the inside of the inkjet printing head. As a result, there is a possibility that the ink flow paths will be narrowed or blocked with the adhesive agent. Therefore, an inkjet printing head produced in such a manner that thin plate-like etching plates are laminated and bonded onto one another by diffusion junction which is one method of metal-metal junction has been proposed (e.g., see JP-A-UM-58-147749 (1983)). According to this technique, the thin plate-like etching plates can be bonded to one another with strong bonding force while the ink flow paths can be prevented from being narrowed or blocked because the adhesive agent is not used so that a surplus of the adhesive agent does not flow into the ink flow paths.

SUMMARY OF THE INVENTION

In a bonding process using metal-bonding, it is necessary to apply a predetermined pressure in a bonding direction onto a subject of bonding in a vacuum atmosphere. However, if such a predetermined pressure is applied in a bonding direction of the etching plates when a large-size ink flow path (common ink chamber) having a large opening is formed in the inside of the inkjet printing head, the etching plate laminated so as to be adjacent to the common ink chamber cannot be supported in a direction opposite to the direction of application of the pressure. As a result, the etching plate is distorted so as to be curved convexly toward the common ink chamber. Accordingly, a gap is formed between the etching plate adjacent to the common ink chamber and another etching plate adjacent to the etching plate, so that the predetermined pressure in the bonding direction cannot be applied on the portion of the gap. For this reason, it is impossible to obtain a sufficient bonding strength between the etching plate adjacent to the common ink chamber and another etching plate adjacent to the etching plate. In addition, reliable metal-bonding cannot be achieved because the size of other ink flow paths formed from these etching plates may be deformed.

Therefore, one of objects of the invention is to provide an inkjet printing head in which even in the case where a common ink chamber is formed in the inside of the inkjet printing head, a plurality of thin plate members adjacent to the common ink chamber can be fixed to one another by metal-metal junction surely.

According to a first aspect of the invention, there is provided an inkjet printing head including: a common ink chamber having an outlet; and an individual ink flow path having a pressure chamber and leads ink from the outlet of the common ink chamber to a nozzle through the pressure chamber, wherein the common ink chamber and the individual ink flow path are formed of a plurality of thin plate members having holes formed thereon, the thin plate members being laminated and fixed onto one another by metal-metal junction, and wherein sectional area of the common ink chamber along a planar direction of the thin plate members is configured to be smaller at an end portion where the outlet is provided than at a central portion in a direction of thickness of the plurality of thin plate members.

According to a second aspect of the invention, there is provided an inkjet printing head including: a common ink chamber having an outlet; and an individual ink flow path having a pressure chamber and leads ink from the outlet of the common ink chamber to a nozzle through the pressure chamber, wherein the common ink chamber and the individual ink flow path are formed of a plurality of thin plate members having holes formed thereon, the thin plate members being laminated and fixed onto one another by metal-metal junction, and wherein a thickest one of a part of the plurality of thin plate members that are laminated above the common ink chamber at a side to the pressure chamber, is positioned at a side to the common ink chamber in the part of the plurality of thin plate members with respect to a central position of the part of the plurality of thin plate members.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

First Embodiment

A preferred embodiment according to a first embodiment of the invention will be described below with reference to the drawings.

Figure 1:
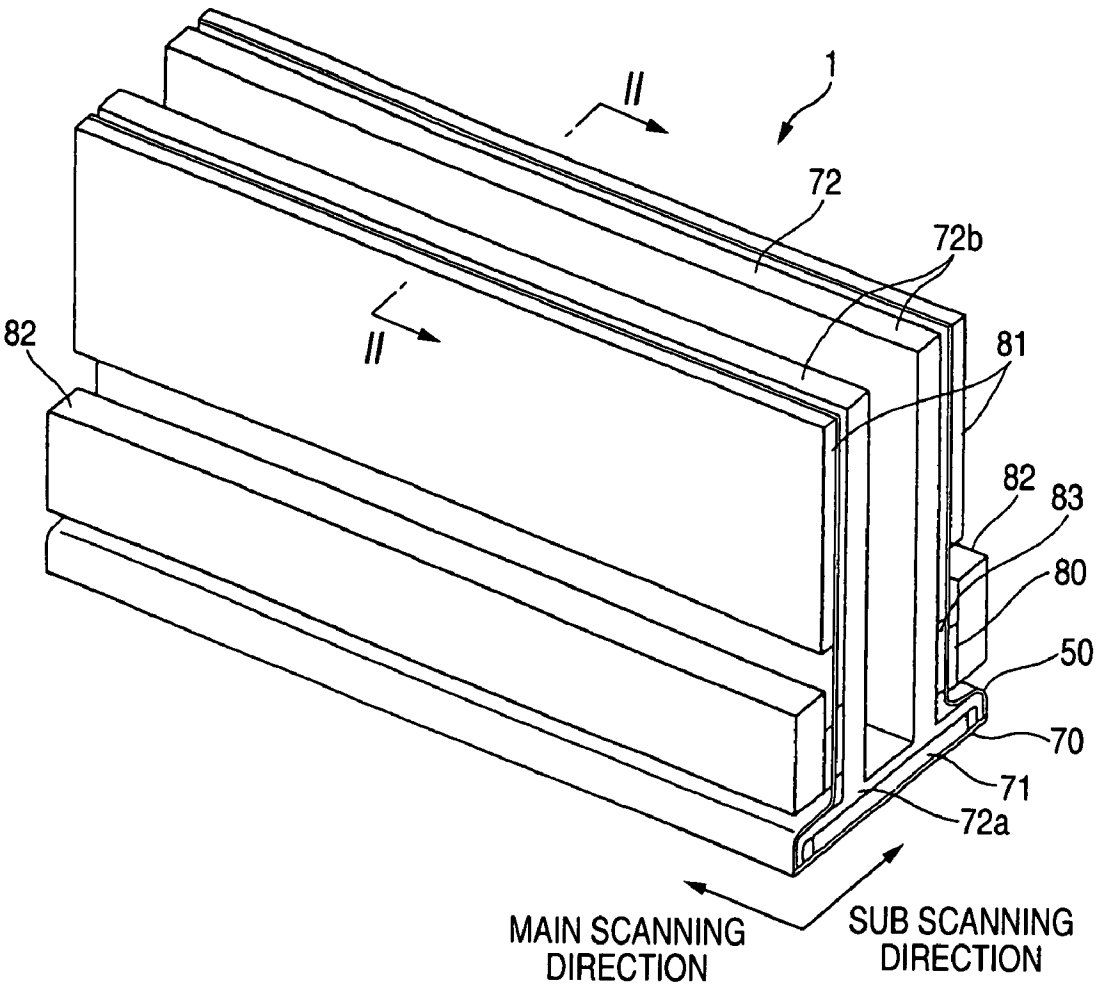
FIG. 1 is a perspective view of an inkjet printing head according to a first embodiment of the invention.
Figure 2:
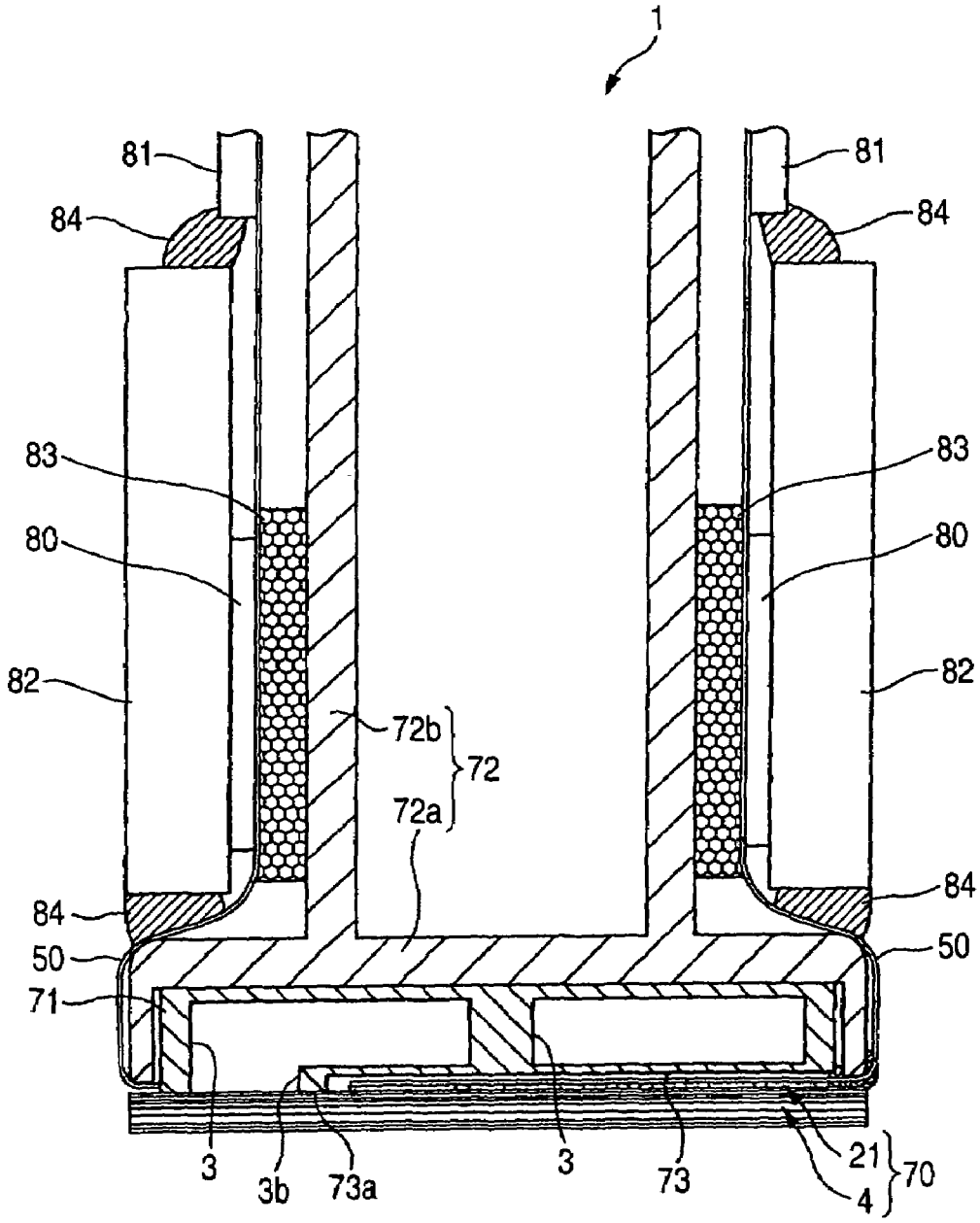
FIG. 2 is a sectional view taken along the line II-II in FIG. 1.

FIG. 1 is a perspective view showing the external appearance of an inkjet printing head according to a first embodiment. FIG. 2 is a sectional view taken along the line II-II in FIG. 1. The inkjet printing head 1 has a head body 70, and a base block 71. The head body 70 is shaped like a flat rectangle extending in a main scanning direction for ejecting ink onto a sheet of paper. The base block 71 is disposed above the head body 70 and includes ink reservoirs 3 formed as flow paths of ink supplied to the head body 70.

The head body 70 includes a flow path unit 4, and a plurality of actuator units 21. An ink flow path is formed in the flow path unit 4. The plurality of actuator units 21 are bonded onto an upper surface of the flow path unit 4. The flow path unit 4 and actuator units 21 are formed in such a manner that a plurality of thin plate members are laminated and bonded to one another. Flexible printed circuit boards (hereinafter referred to as FPCs) 50 which are feeder circuit members are bonded onto an upper surface of the actuator units 21 and pulled out in left and right direction. The FPCs 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 (shown in FIG. 3) only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go along surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 (will be described later in detail) by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICs 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50 respectively. That is, the heat sinks 82, the boards 81 and the FPCs 50 are bonded to one another by the seal members 84.

Figure 3:
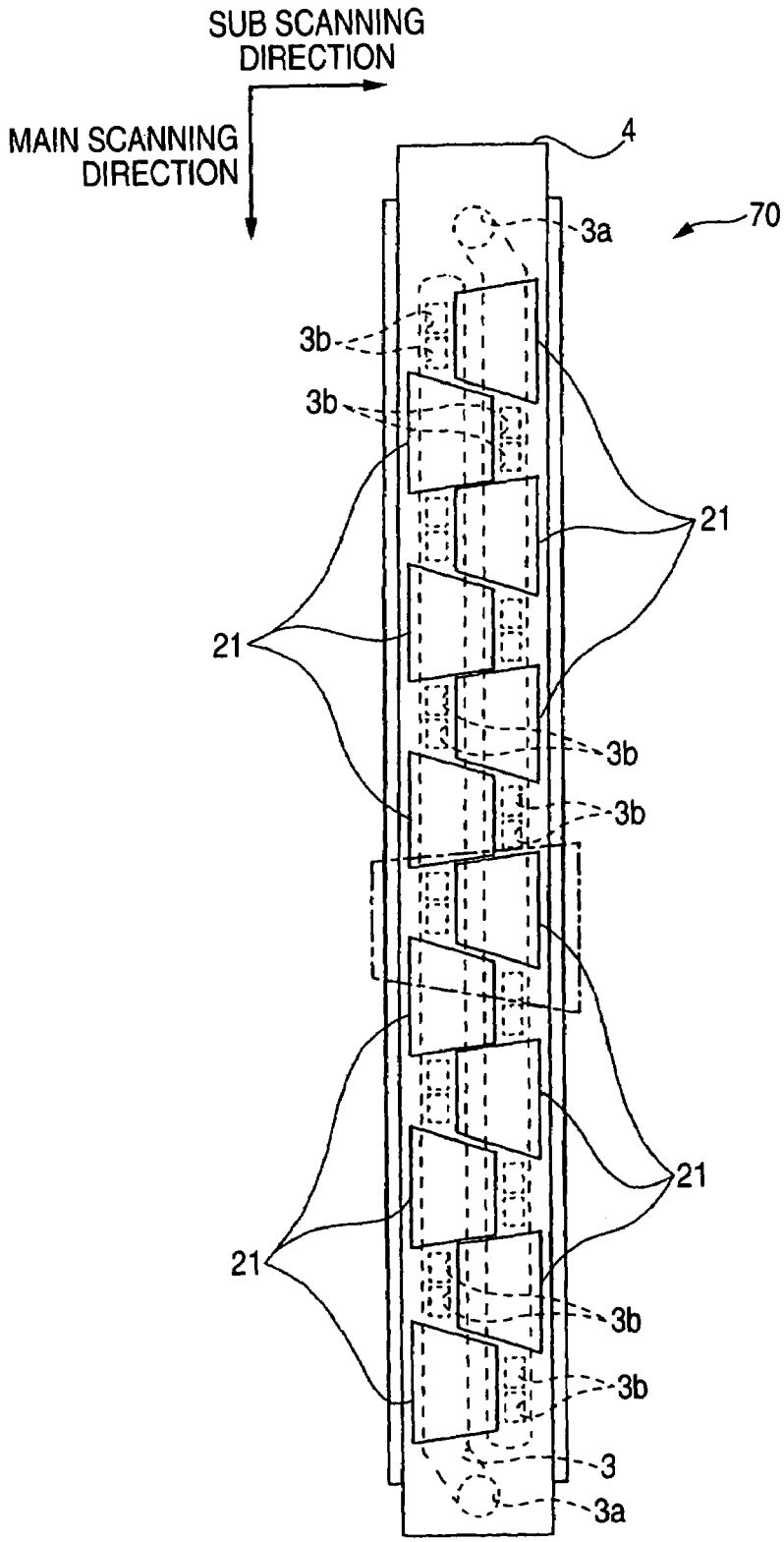
FIG. 3 is a plan view of a head body included in the inkjet printing head depicted in FIG. 2.

FIG. 3 is a plan view of the head body included in the inkjet printing head depicted in FIG. 1. In FIG. 3, the ink reservoirs 3 formed in the base block 71 are drawn virtually by the broken line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are disposed in zigzag.

The plurality of actuator units 21 each having a trapezoid flat shape are disposed in regions where the openings 3*b* are not provided. The plurality of actuator units 21 are disposed in zigzag so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 70.

Figure 4:
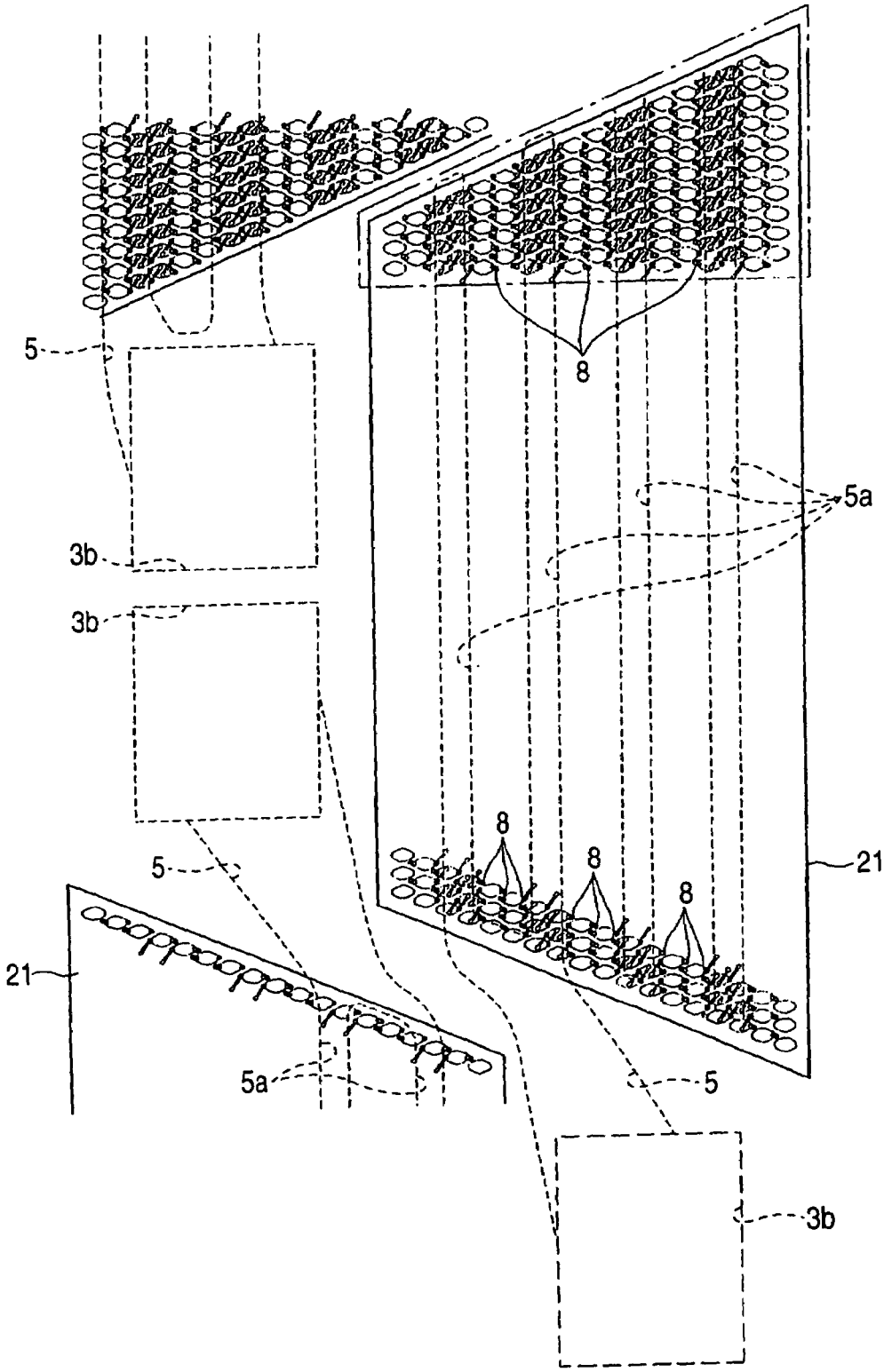
FIG. 4 is an enlarged view of a region surrounded by the chain line shown in FIG. 3.

FIG. 4 is an enlarged view of a region surrounded by the chain line in FIG. 3. As shown in FIG. 4, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* separated from adjacent openings 3*b* extend from two inclined sides of each actuator unit 21. That is, four sub manifolds 5*a* in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 4 shows several nozzles 8 for the sake of simplification, nozzles 8 are actually arranged on the whole of the ink ejection region.

Figure 5:
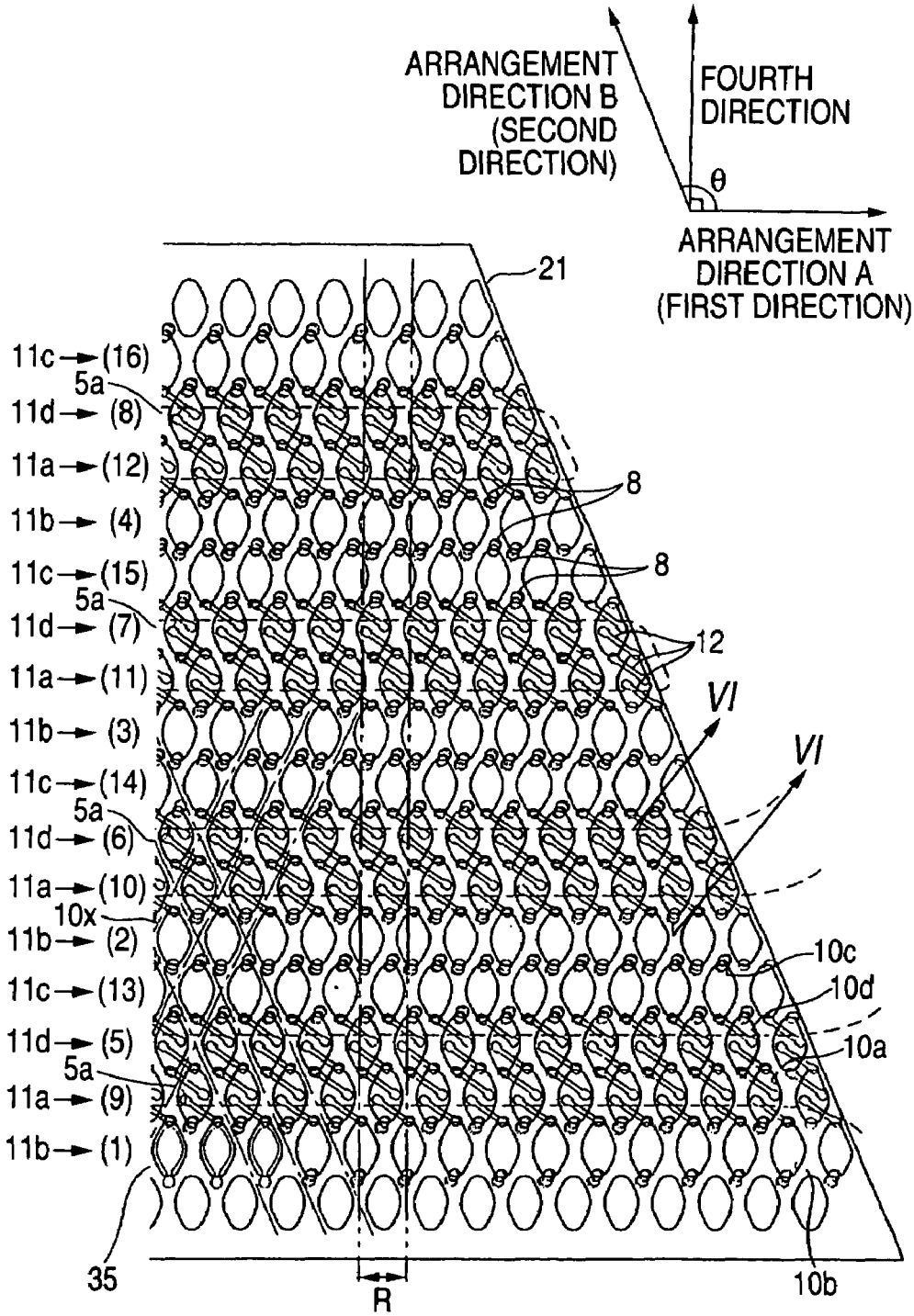
FIG. 5 is an enlarged view of a region surrounded by the chain line shown in FIG. 4.

FIG. 5 is an enlarged view of a region surrounded by the chain line in FIG. 4. FIGS. 4 and 5 show a state in which a plane of a large number of pressure chambers 10 disposed in the form of a matrix in the flow path unit 4 is viewed from a direction perpendicular to the ink ejection surface. Each of the pressure chambers 10 is shaped substantially like a rhomboid having rounded corners in plan view. The long diagonal line of the rhomboid is parallel to the direction of the width of the flow path unit 4. Each pressure chamber 10 has one end connected to a corresponding nozzle 8, and the other end connected to a corresponding sub manifold 5*a* as a common ink flow path through an aperture 12. An individual electrode 35 having a planar shape similar to but size smaller than that of each pressure chamber 10 is formed on the actuator unit 21 so as to be adjacent to the pressure chamber 10 in plan view. Some of a large number of individual electrodes 35 are shown in FIG. 5 for the sake of simplification. Incidentally, the pressure chambers 10 and apertures 12 that must be expressed by the broken line in the actuator units 21 or in the flow path unit 4 are expressed by the solid line in FIGS. 4 and 5 to make it easy to understand the drawings.

In FIG. 5, a plurality of virtual rhombic regions 10 in which the pressure chambers 10 are stored respectively are disposed adjacently in the form of a matrix both in an arrangement direction A (first direction) and in an arrangement direction B (second direction) so that adjacent virtual rhombic regions 10*x* have common sides not overlapping each other. The arrangement direction A is a direction of the length of the inkjet printing head 1, that is, a direction of extension of each sub manifold 5*a*. The arrangement direction A is parallel to the short diagonal line of each rhombic region 10*x*. The arrangement direction B is a direction of one inclined side of each rhombic region 10*x* in which an obtuse angle θ is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 10 disposed adjacently in the form of a matrix in the two arrangement directions A and B are formed at intervals of a distance corresponding to 37.5 dpi along the arrangement direction A. The pressure chambers 10 are formed so that eighteen pressure chambers 10 are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*->11*d*->11*a*->11*b*->11*c*->11*d*->. . . ->11*b* from an upper side to a lower side of each actuator unit 21.

In pressure chambers 10*a* forming the first pressure chamber column 11*a* and pressure chambers 10*b* forming the second pressure chamber column 11*b*, nozzles 8 are unevenly distributed on a lower side of the paper surface of FIG. 5 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming the third pressure chamber column 11*c* and pressure chambers 10*d* forming the fourth pressure chamber column 11*d*, nozzles 8 are unevenly distributed on an upper side of the paper surface of FIG. 5 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 6:
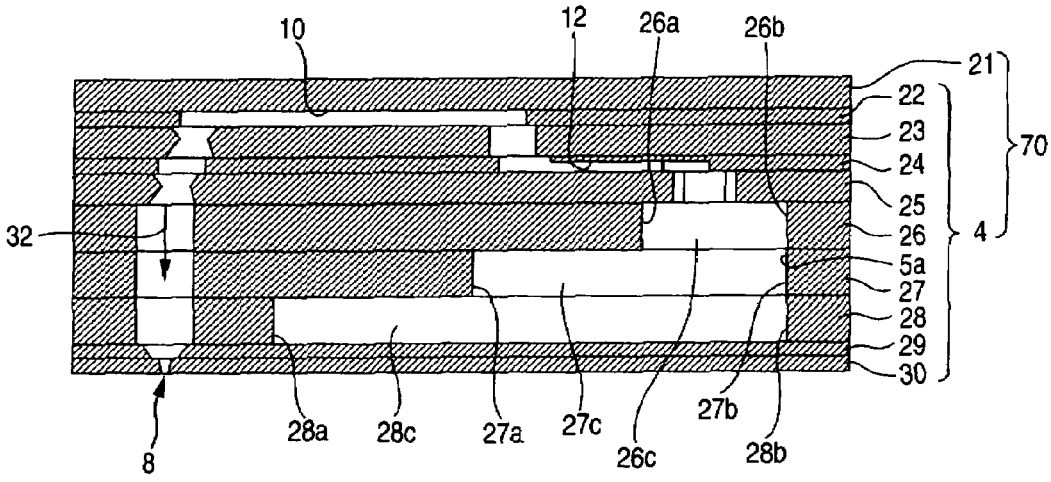
FIG. 6 is a sectional view taken along the line VI-VI in FIG. 5.
Figure 7:
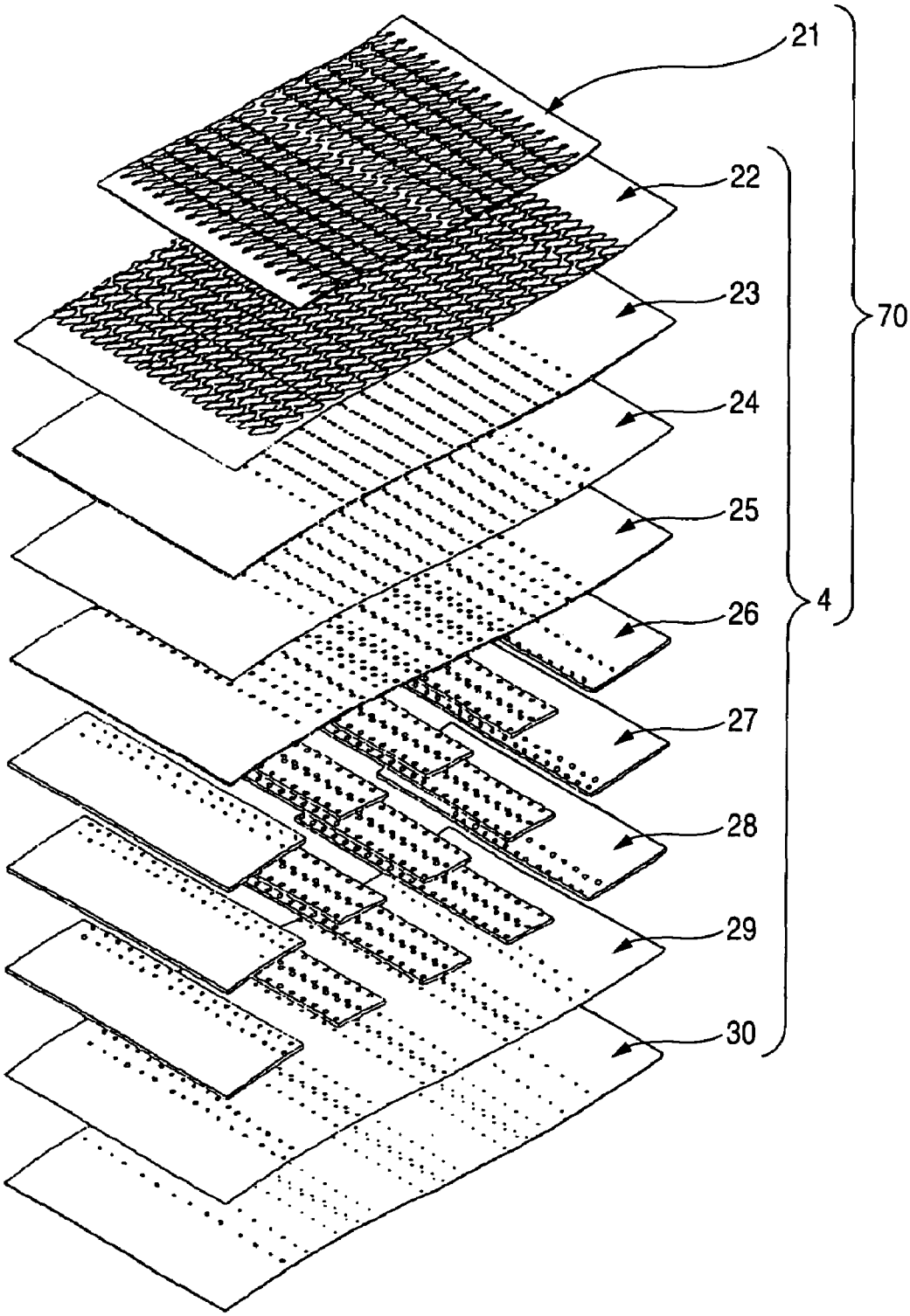
FIG. 7 is a partially exploded perspective view of the head body depicted in FIG. 6.

Next, the sectional structure of the head body 70 will be described more specifically with reference to FIGS. 6 and 7. FIG. 6 is a sectional view taken along the line VI-VI in FIG. 5. A pressure chamber 10*a* belonging to a first pressure chamber column 11*a* is shown in FIG. 6. FIG. 7 is a partially exploded perspective view of the head body. As is obvious from FIG. 6, each nozzle 8 is connected to a sub manifold 5*a* through the pressure chamber 10 (10*a*) and an aperture 12. In this manner, an individual ink flow path 32 for leading ink from an outlet of the sub manifold 5*a* to the nozzle 8 through the aperture 12 and the pressure chamber 10 is formed in the head body 70 so as to be disposed in accordance with every pressure chamber 10.

As is also obvious from FIG. 7, the head body 70 has a laminated structure in which ten sheet materials in total are laminated on one another, that is, an actuator unit 21, a cavity plate 22, a base plate 23, an aperture plate 24, a supply plate 25, manifold plates 26, 27 and 28, a cover plate 29 and a nozzle plate 30 are laminated successively in descending order. The ten sheet materials except the actuator unit 21, that is, nine metal plates form a flow path unit 4. The respective metal plates are collectively bonded to one another by means of diffusion junction.

As will be described later in detail, the actuator unit 21 includes a laminate of four piezoelectric sheets 41 to 44 (see FIG. 8A) as four layers, and electrodes disposed so that only the uppermost layer is provided as a layer having a portion serving as an active layer at the time of application of electric field (hereinafter simply referred to as "active layer-including layer") while the residual three layers are provided as non-active layers. The cavity plate 22 is a metal plate having a large number of approximately rhomboid openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding ink nozzle 8. The aperture plate 24 is a metal plate which has apertures 12 formed as half-etching regions each for connecting two holes in one pressure chamber 10 of the cavity plate 22, and holes each for connecting one pressure chamber 10 of the cavity plate 22 to a corresponding ink nozzle 8.

In the embodiment, the apertures 12 serves as a restricted flow path that restricts flow of the ink and provided between the common ink chamber (manifolds 5) and the pressure chamber 10 in the individual ink flow path.

The supply plate 25 is a metal plate which has holes each for connecting an aperture 12 for one pressure chamber 10 of the cavity plate 22 to a corresponding sub manifold 5*a*, and holes each for connecting the pressure chamber 10 to the ink nozzle 8. The manifold plates 26, 27 and 28 are metal plates which have holes 26*c*, 27*c* and 28*c* connected to one another at the time of lamination for forming the manifolds 5*a*, and holes each for connecting one pressure chamber 10 of the cavity plate 22 to a corresponding ink nozzle 8. The cover plate 29 is a metal plate which has holes each for connecting one pressure chamber 10 of the cavity plate 22 to a corresponding ink nozzle 8. The nozzle plate 30 is a metal plate which has nozzles 8 each provided for one pressure chamber 10 of the cavity plate 22.

These nine metal plates are laminated on one another while positioned so that individual ink flow paths 32 as shown in FIG. 6 are formed. Each of the individual ink flow paths 32 first extends upward from the sub manifold 5*a*, extends horizontally in the aperture 12, extends further upward, extends horizontally in the pressure chamber 10 again, extends obliquely downward for a while in a direction of departing from the aperture 12 and extends vertically downward to the nozzle 8.

Particularly, each sub manifold 5*a* serving as the common ink chamber is formed from the three holes 26*c*, 27*c* and 28*c* of the manifold plates 26, 27 and 28 as described above. The sectional areas of the metal plates in each sub manifold 5*a* in a planar direction, that is, the opening areas of the holes 26*c*, 27*c* and 28*c* of the manifold plates 26, 27 and 28 for forming each sub manifold 5*a* become larger stepwise (in three stages) in order of lamination of the manifold plates 26, 27 and 28 when viewed from the aperture plate 24 side to the cover plate 29 side.

The holes 26*c*, 27*c* and 28*c* of the manifold plates 26, 27 and 28 for forming each sub manifold 5*a* have inner walls 26*a*, 26*b*, 27*a*, 27*b*, 28*a* and 28*b* which serve as inner walls in the direction of the width of the sub manifold 5*a*. The inner walls 26*a*, 27*a* and 28*a* are inner walls on the bottom side (shown in the lower side of FIG. 5) of the sub manifold 5*a* shaped like a trapezoid as shown in FIG. 5. The inner walls 26*b*, 27*b* and 28*b* are inner walls on the top side (shown in the upper side of FIG. 5) of the sub manifold 5*a*. Incidentally, a widthwise shape formed by the inner walls 28*a* and 28*b* of the manifold plate 28 is expressed as the widthwise shape of the sub manifold 5*a* shown in FIGS. 4 and 5. The inner walls 26*a*, 27*a* and 28*a* are disposed so that the inner walls on the bottom side of the sub manifold 5*a* are shifted to the bottom side stepwise when viewed from the aperture plate 24 side to the cover plate 29 side. On the other hand, the inner walls 26*b*, 27*b* and 28*b* are disposed so that the inner walls on the upper side of the sub manifold 5*a* are aligned on a straight line. That is, the sectional shape of the sub manifold 5*a* in the widthwise direction is substantially like a right-angled triangle.

Figure 8A:
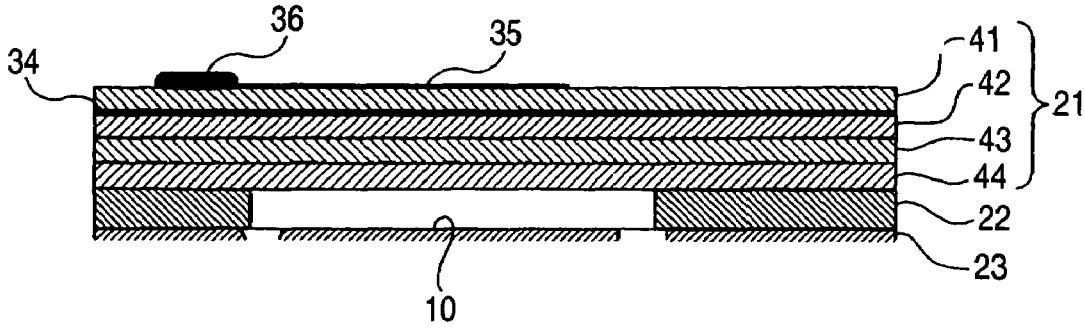
FIG. 8A is an enlarged view of an actuator unit depicted in FIG. 6.
Figure 8B:
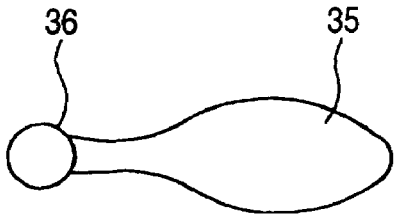
FIG. 8B is an enlarged view of each individual electrode mounted on the actuator unit.

Next, the configuration of the actuator unit 21 laminated on the cavity plate 22 as the uppermost layer of the flow path unit 4 will be described. FIG. 8A is a partially enlarged sectional view showing the actuator unit 21 and a pressure chamber 10. FIG. 8B is a plan view showing the shape of an individual electrode bonded to a surface of the actuator unit 21.

As shown in FIG. 8A, the actuator unit 21 includes four piezoelectric sheets 41, 42, 43 and 44 formed to have a thickness of about 15 μm equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35 are formed on the piezoelectric sheet 41 as the uppermost layer. A common electrode 34 having a thickness of about 2 μm is interposed between the piezoelectric sheet 41 as the uppermost layer and the piezoelectric sheet 42 located under the piezoelectric sheet 41 so that the common electrode 34 is formed on the whole surface of the piezoelectric sheet 42. The individual electrodes 35 and the common electrode 34 are made of a metal material such as Ag-Pd.

As shown in FIG. 8B, each individual electrode 35 has a thickness of about 1 μm and substantially has a rhomboid shape nearly similar to the shape of the pressure chamber 10 shown in FIG. 5. An acute-angled portion of each approximately rhomboid individual electrode 35 extends. A circular land portion 36 having a diameter of about 160 μm is provided at an end of the extension of the acute-angled portion of the individual electrode 35 so as to be electrically connected to the individual electrode 35. For example, the land portion 36 is made of gold containing glass frit. As shown in FIG. 8A, the land portion 36 is bonded onto a surface of the extension of the individual electrode 35.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 are not displaced spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 8A, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

According to the first embodiment described above, the pressure applied on the respective metal plates in the direction of thickness for metal-bonding the respective metal plates in regions adjacent to the sub manifolds 5*a* is successively diffused from the supply plate 25 to the manifold plates 26, 27 and 28 for forming the sub manifolds 5*a*. For this reason, the supply plate 25 is not curved convexly toward the sub manifolds 5*a*, so that there is neither formation of a gap formed between the supply plate 25 and the aperture plate 24 nor deformation in inner shape of the ink flow paths of the apertures 12 constituted by the supply plate 25 and the aperture plate 24. Accordingly, even in the case where the sub manifolds 5*a* are formed in the flow path unit 4, the plurality of metal plates adjacent to the sub manifolds 5*a* can be fixed to one another by metal-metal junction surely.

In addition, because the sub manifolds 5*a* are formed in such a manner that the plurality of holes 26*c*, 27*c* and 28*c* formed in the manifold plates 26, 27 and 28 are connected to one another, the sub manifolds 5*a* can be produced easily in the condition that each sub manifold 5*a* has a desired sectional shape.

Figure 9A:
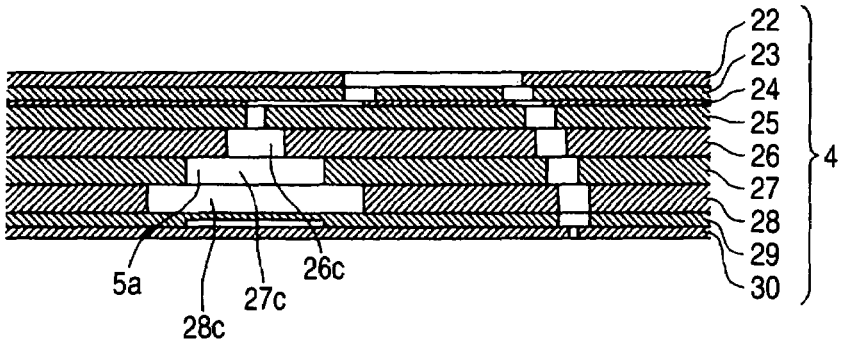
FIGS. 9A to 9D are sectional views showing modifications of the head body of the inkjet printing head depicted in FIG. 1.

Although the first embodiment has been described on the case where the sectional shape of each sub manifold 5*a* in the widthwise direction is substantially like a right-angled triangle, the shape of each sub manifold 5*a* is not limited as long as the sectional areas of the respective metal plates in the planar direction in each manifold 5*a* increase when viewed from the aperture plate 24 side to the cover plate 29 side. FIGS. 9A to 9D are sectional views showing modifications of the head body 70. For example, as shown in FIG. 9A, the inner walls of the holes 26*c*, 27*c* and 28*c* formed in the manifold plates 26, 27 and 28 may be widened stepwise on the widthwise opposite sides of each sub manifold 5*a* in order of lamination of the manifold plates 26, 27 and 28 so that the sectional shape of each sub manifold 5*a* in the widthwise direction is substantially like a triangle.

Figure 9B:
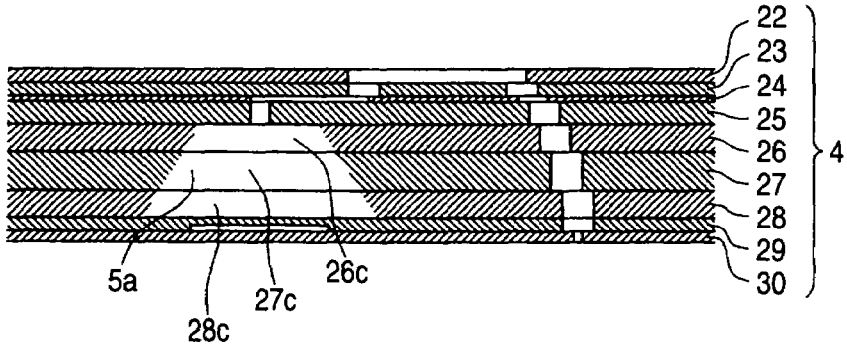
Figure 9C:
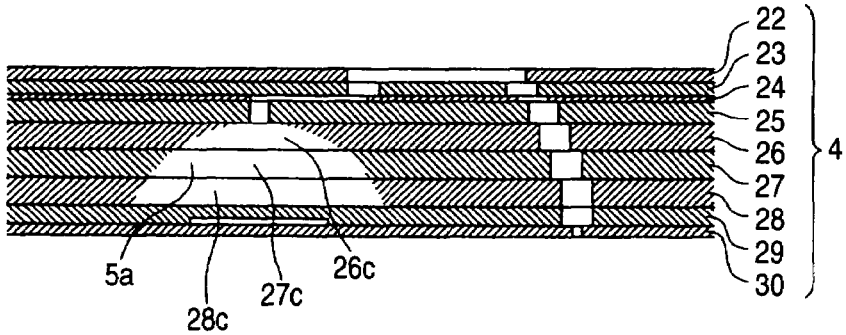

Although the modification has been described on the case where the areas of the holes 26*c*, 27*c* and 28*c* of the manifold plates 26, 27 and 28 constituting the sub manifolds 5*a* increase stepwise in accordance with the manifold plates 26, 27 and 28 when viewed from the aperture plate 24 side to the cover plate 29 side, the shapes of the holes 26*c*, 27*c* and 28*c* are not limited thereto. The holes 26*c*, 27*c* and 28*c* of the manifold plates 26, 27 and 28 may be shaped so that the areas of the holes 26*c*, 27*c* and 28*c* change continuously. For example, the sectional shape of each sub manifold 5*a* in the widthwise direction may be substantially like a triangle or right-angled triangle formed from lines. The sectional shape of each sub manifold 5*a* in the widthwise direction may be like a trapezoid as shown in FIG. 9B or like a semicircle as shown in FIG. 9C.

Figure 9D:
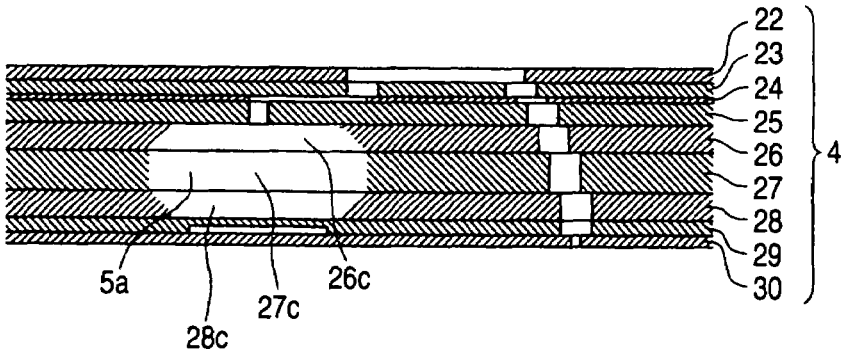

Although FIG. 6 shows the configuration in which the areas of all the holes 26*c*, 27*c* and 28*c* of the three manifold plates 26, 27 and 28 constituting the sub manifolds 5*a* change so as to increase in accordance with the order of lamination, the invention is not limited to the configuration. For example, as shown in FIG. 9D, configuration may be made so that the areas of the holes 26*c* and 27*c* of the manifold plates 26 and 27 change so as to increase in accordance with the order of lamination while the areas of the holes 27*c* and 28*c* of the manifold plates 27 and 28 change so as to decrease in accordance with the order of lamination.

Second Embodiment

A second embodiment of the invention will be described below with reference to the drawings.

A head body 70A according to the second embodiment corresponds to the head body 70 according to the first embodiment. The second embodiment is substantially the same as the first embodiment except the sectional structure of the head body 70A in the second embodiment. Accordingly, only the sectional structure of the head body 70A in the second embodiment will be described.

Figure 10:
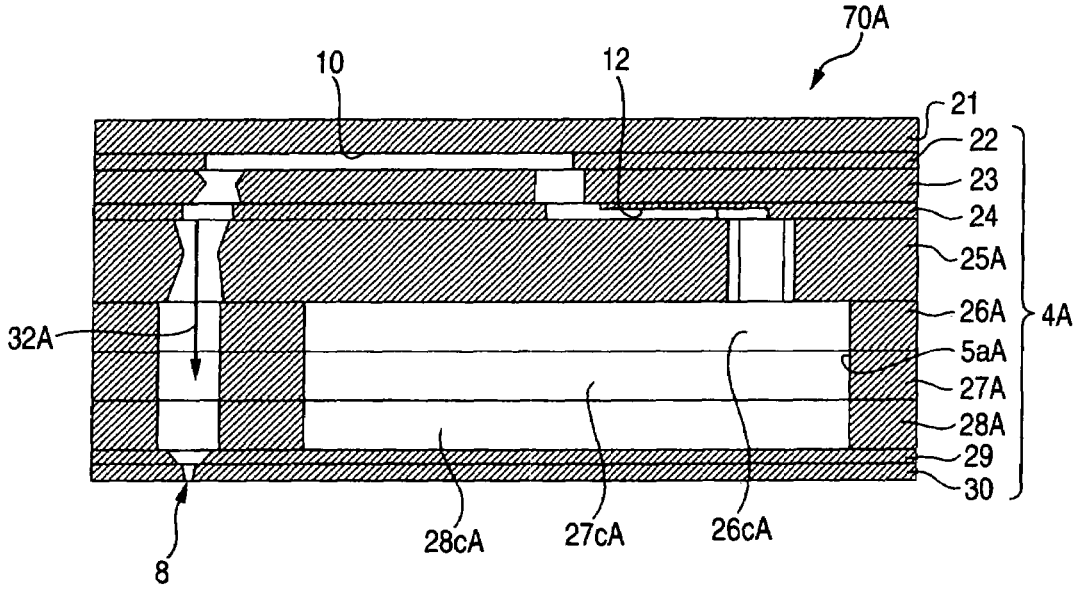
FIG. 10 is a sectional view of the head body of the inkjet printing head according to a second embodiment of the invention.

FIG. 10 is a sectional view taken along the line VI-VI In FIG. 5. A pressure chamber 10*a* belonging to a first pressure chamber column 11*a* is shown in FIG. 10. As is obvious from FIG. 10, a nozzle 8 is connected to a sub manifold 5*a*A through the pressure chamber 10 (10*a*) and an aperture 12. In this manner, an individual ink flow path 32A for leading ink from an outlet of the sub manifold 5*a*A to the nozzle 8 through the aperture 12 and the pressure chamber 10 is formed in the head body 70A in accordance with every pressure chamber 10.

The head body 70A has a laminated structure in which ten sheet materials in total are laminated on one another, that is, an actuator unit 21, a cavity plate 22, a base plate 23, an aperture plate 24, a supply plate 25A, manifold plates 26A, 27A and 28A, a cover plate 29 and a nozzle plate 30 are laminated successively in descending order. The ten sheet materials except the actuator unit 21, that is, nine metal plates form a flow path unit 4A. The respective metal plates are collectively bonded to one another by means of diffusion junction.

The actuator unit 21 includes a laminate of four piezoelectric sheets 41 to 44 as four layers, and electrodes disposed so that only the uppermost layer is provided as a layer having a portion serving as an active layer at the time of application of electric field while the residual three layers are provided as non-active layers. The cavity plate 22 is a metal plate having a large number of approximately rhomboid openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding ink nozzle 8. The aperture plate 24 is a metal plate which has apertures 12 formed as half-etching regions each for connecting two holes in one pressure chamber 10 of the cavity plate 22, and holes each for connecting one pressure chamber 10 of the cavity plate 22 to a corresponding ink nozzle 8. The supply plate 25A is a metal plate which has holes each for connecting an aperture 12 for one pressure chamber 10 of the cavity plate 22 to a corresponding sub manifold 5*a*A, and holes each for connecting the pressure chamber 10 to the ink nozzle 8. The supply plate 25A is formed to be the thickest among the metal plates constituting the flow path unit 4. The thickness of the supply plate 25A is selected so that the supply plate 25A is not curved toward the sub manifold 5*a*A side by the pressure applied at the time of diffusion junction. The manifold plates 26A, 27A and 28A are metal plates which have holes 26*c*A, 27*c*A and 28*c*A connected to one another at the time of lamination for forming the sub manifolds 5*a*A, and holes each for connecting one pressure chamber 10 of the cavity plate 22 to a corresponding ink nozzle 8. The cover plate 29 is a metal plate which has holes each for connecting one pressure chamber 10 of the cavity plate 22 to a corresponding ink nozzle 8. The nozzle plate 30 is a metal plate which has nozzles 8 each provided for one pressure chamber 10 of the cavity plate 22.

These nine metal plates are laminated on one another while positioned so that individual ink flow paths 32A as shown in FIG. 10 are formed. Each of the individual ink flow paths 32A first extends upward from the sub manifold 5*a*A, extends horizontally in the aperture 12, extends further upward, extends horizontally in the pressure chamber 10 again, extends obliquely downward for a while in a direction of departing from the aperture 12 and extends vertically downward to the nozzle 8.

Each sub manifold 5*a*A serving as an ink flow path is formed from the three holes 26*c*A, 27*c*A and 28*c*A of the manifold plates 26A, 27A and 28A as described above. The sectional shape of each sub manifold 5*a*A in the widthwise direction is like a rectangle in which the length in the widthwise direction (width) is larger than the length in the direction of lamination of the metal plates (height).

According to the second embodiment described above, the supply plate 25A having the aforementioned thickness is laminated so as to be adjacent to the manifold plate 26A having the holes 26*c*A as large openings in regions adjacent to the sub manifolds 5*a*A respectively. For this reason, the supply plate 25A is not curved convexly toward the sub manifold 5*a*A side by the pressure applied in the direction of the thickness of the respective metal plates when the respective metal plates are fixed to one another by metal-metal junction. Accordingly, there is neither formation of a gap between the supply plate 25A and the aperture plate 24 nor deformation in inner shape of the ink flow paths of the apertures 12 constituted by the supply plate 25A and the aperture plate 24. As a result, even in the case where the sub manifolds 5*a*A are formed in the inside of the metal plates, the metal plates adjacent to the sub manifolds 5*a*A can be fixed to one another by metal-metal junction surely.

Figure 11:
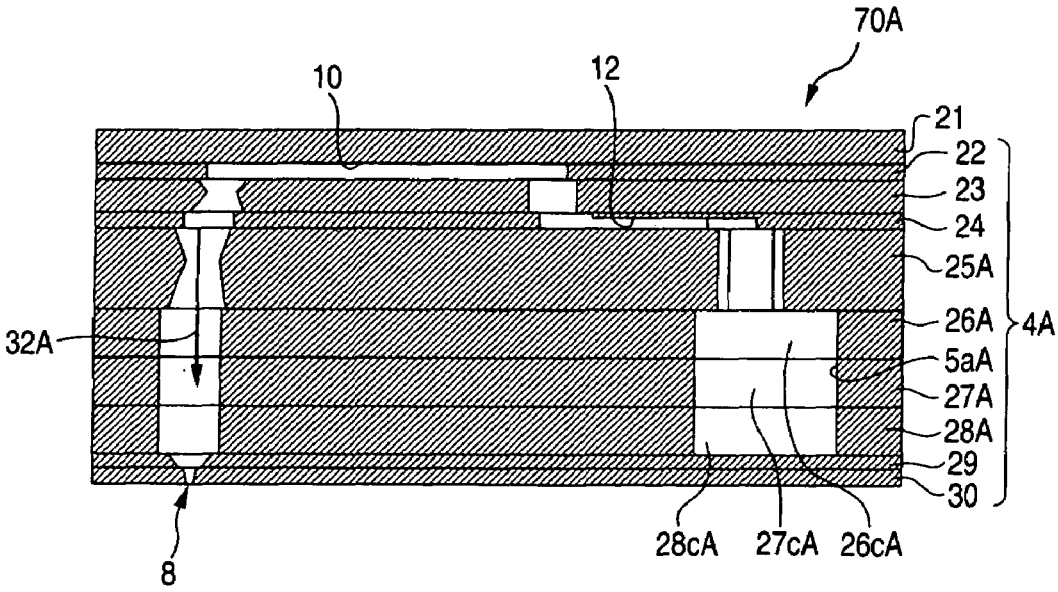
FIG. 11 shows a modification of the head body depicted in FIG. 10.

Although the second embodiment has been described on the case where the sectional shape of each sub manifold 5*a*A is like a rectangle in which the length in the widthwise direction (height) is larger than the length in the direction of lamination of the metal plates (width), the shape of each manifold 5*a*A is not limited thereto. FIG. 11 is a sectional view showing a modification of the head body 70A. For example, as shown in FIG. 11, the sectional shape of each sub manifold 5*a*A may be like a rectangle in which the length in the widthwise direction (width) is smaller than the length in the direction of lamination of the metal plates (height). According to this modification, the gap can be prevented from being formed between the supply plate 25A and the aperture plate 24 while the inner shape of the ink flow paths of the apertures 12 constituted by the supply plate 25A and the aperture plate 24 can be prevented from being deformed.

Although preferred embodiments of the invention have been described above, the invention is not limited to the embodiments and various changes may be made without departing from the scope of claim. For example, though the first embodiment has shown the configuration in which each sub manifold 5*a* is formed from the holes 26*c*, 27*c* and 28*c* of the three manifold plates 26, 27 and 28, the invention is not limited to the configuration. Each sub manifold 5*a* may be formed from holes of two or less metal plates or from holes of four or more metal plates. Incidentally, when each sub manifold 5*a* is formed from a hole of one metal plate, the sectional area, in the planar direction, of the hole of the metal plate used for forming the sub manifold 5*a* is set so as to increase when viewed from the aperture plate 24 side to the cover plate 29 side.

Although the second embodiment has shown the configuration in which the supply plate 25A is the thickest among the metal plates constituting the flow path unit 4A, the invention is not limited to the configuration but may be also applied to a configuration in which a metal plate other than the supply plate such as the base plate is the thickest among the metal plates constituting the flow path unit 4A. As described in the first embodiment, the sectional areas, in the planar direction, of the holes of the metal plates constituting the sub manifold 5*a*A may be formed so as to increase when viewed from the aperture plate 24 side to the cover plate 29 side.

Although the first and second embodiments have shown the configuration in which the metal plates are bonded to one another by means of diffusion junction, the invention is not limited to the configuration. For example, the metal plates may be bonded to one another by solder bonding. Incidentally, when solder bonding is used, metal plates such as copper-plated, silver-plated or gold-plated metal plates good in wettability to solder or stainless steel plates containing at least one of these elements are bonded to one another at a high temperature in a vacuum atmosphere.

According to one aspect of invention, the inkjet printing head includes a common ink chamber, and individual ink flow paths for leading ink from an outlet of the common ink chamber to nozzles through pressure chambers respectively, the common ink chamber and the individual ink flow paths being formed in such a manner that a plurality of thin plate members having holes are fixed to one another by metal-metal junction while laminated on one another, wherein the sectional area of the common ink chamber along a planar direction of the plurality of thin plate members is configured so that the sectional area at an end portion on the outlet side of the common ink chamber is smaller than the sectional area in a central portion in a direction of thickness of the plurality of thin plate members.

According to the configuration of the above, pressure applied in the direction of the thickness of the thin plate members when the thin plate members are fixed to one another by metal-metal junction in regions adjacent to the common ink chamber is diffused to the thin plate members constituting the common ink chamber. Accordingly, the thin plate members can be prevented from being curved (convexly toward the common ink chamber). Accordingly, the phenomenon that a gap is formed between the thin plate members or the inner shape of ink flow paths formed between the thin plate members is deformed can be avoided. As a result, even in the case where the common ink chamber is formed in the inside of the thin plate members, the plurality of thin plate members adjacent to the common ink chamber can be fixed to one another by metal-metal junction surely.

preferably, in the configuration, the sectional area of the common ink chamber along a planar direction of the plurality of thin plate members is configured so that the sectional area at an end portion on the outlet side of the common ink chamber is smaller than the sectional area in a central portion in a direction of thickness of the plurality of thin plate members while the sectional area in the vicinity of the other end portion is larger than the sectional area in the vicinity of the central portion. According to this configuration, the pressure can be more largely diffused to the thin plate members constituting the common ink chamber. Accordingly, the thin plate members can be prevented from being curved (convexly toward the common ink chamber). Accordingly, the phenomenon that a gap is formed between the thin plate members or the inner shape of ink flow paths formed between the thin plate members is deformed can be avoided more sufficiently.

The sectional area of the common ink chamber along a planar direction of the plurality of thin plate members may change stepwise in three or more stages at one end portion on the outlet side of the common ink chamber or may change continuously at one end portion on the outlet side of the common ink chamber. According to this configuration, prevention of formation of a gap between the thin plate members can be easily combined with keeping of the volume of the common ink chamber.

Preferably, the common ink chamber may be formed in such a manner that the holes formed in the plurality of thin plate members laminated adjacently on one another are connected to one another. According to this configuration, the common ink chamber can be produced easily.

According to another aspect of the invention, the inkjet printing head includes a common ink chamber, and individual ink flow paths for leading ink from an outlet of the common ink chamber to nozzles through pressure chambers respectively, the common ink chamber and the individual ink flow paths being formed in such a manner that a plurality of thin plate members having holes are fixed to one another by metal-metal junction while laminated on one another, wherein the thickest one of thin plate members adjacent to the thin plate members constituting the common ink chamber in the direction of lamination is located between the central position of the plurality of thin plate members in the direction of lamination and the common ink chamber.

According to the configuration of the above, the thickest thin plate member is hardly deformed by pressure applied in the direction of the thickness of the thin plate members when the plurality of thin plate members are fixed to one another by metal-metal junction in regions adjacent to the common ink chamber. Accordingly, the thin plate members can be prevented from being curved (convexly toward the common ink chamber). Accordingly, the phenomenon that a gap is formed between the thin plate members or the inner shape of ink flow paths formed between the thin plate members is deformed can be avoided. As a result, even in the case where the common ink chamber is formed in the inside of the thin plate members, the plurality of thin plate members adjacent to the common ink chamber can be fixed to one another by metal-metal junction surely.

Preferably, in the above configuration, the thickest thin plate member may be configured to serve as a wall of the common ink chamber. According to this configuration, pressure is concentrated on the thickest thin plate member. Accordingly, the thin plate members can be prevented from being curved. Accordingly, the phenomenon that a gap is formed between the thin plate members or the inner shape of ink flow paths formed between the thin plate members is deformed can be avoided more sufficiently.

The common ink chamber may extend along the pressure chambers and may have such a shape that the length of the common ink chamber in the direction of lamination is larger than the width of the common ink chamber in a direction perpendicular to the direction of extension. According to this configuration, the phenomenon that a gap is formed between the thin plate members because of distortion of the thin plate members can be avoided more sufficiently.

Figure 12:
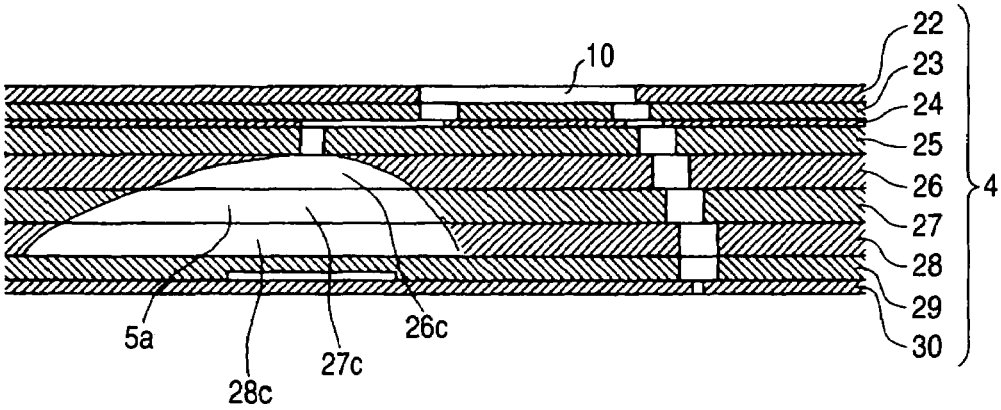
FIG. 12 is a sectional view showing another modifications of the head body of the inkjet printing head.

In the inkjet printing head according to the embodiments described above, rate of change of the sectional area of the common ink chamber (manifolds 5) may be configured to be larger at one side where the pressure chamber 10 is disposed than at an opposite side positioned oppositely to the one side with respect to the outlet, as shown in FIG. 12. According to this configuration, the thin plate members can be prevented from being curved (convexly toward the common ink chamber). Accordingly, the phenomenon that a gap is formed between the thin plate members or the inner shape of ink flow paths formed between the thin plate members is deformed can be avoided. As a result, even in the case where the common ink chamber is formed in the inside of the thin plate members, the plurality of thin plate members adjacent to the common ink chamber can be fixed to one another by metal-metal junction surely.

Figure 13:
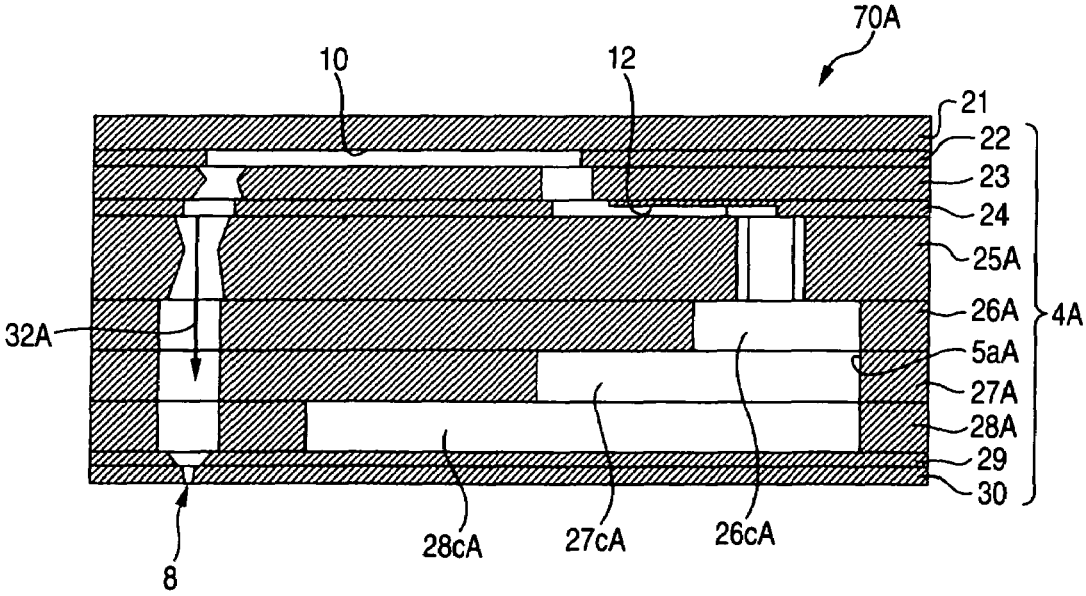
FIG. 13 is a sectional view of the head body of the inkjet printing head according to another embodiment of the invention.

According to the invention, an inkjet printing head having a structure shown in FIG. 13 is also attained. The inkjet printing head shown in FIG. 13 has a structure including: a common ink chamber having an outlet; and an individual ink flow path having a pressure chamber and leads ink from the outlet of the common ink chamber to a nozzle through the pressure chamber. The common ink chamber and the individual ink flow path are formed of a plurality of thin plate members having holes formed thereon, the thin plate members being laminated and fixed onto one another by metal-metal junction. And, sectional area of the common ink chamber along a planar direction of the thin plate members is configured to be smaller at an end portion where the outlet is provided than at a central portion in a direction of thickness of the plurality of thin plate members. In the configuration shown in FIG. 13, a thickest one of a part of the plurality of thin plate members that are laminated above the common ink chamber at a side to the pressure chamber, is positioned at a side to the common ink chamber in the part of the plurality of thin plate members with respect to a central position of the part of the plurality of thin plate members.

According to the configuration shown in FIG. 13, the thin plate members can be prevented from being curved (convexly toward the common ink chamber). Accordingly, the phenomenon that a gap is formed between the thin plate members or the inner shape of ink flow paths formed between the thin plate members is deformed can be avoided. As a result, even in the case where the common ink chamber is formed in the inside of the thin plate members, the plurality of thin plate members adjacent to the common ink chamber can be fixed to one another by metal-metal junction surely.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet printing head comprising:

a common ink chamber having an outlet; and an individual ink flow path having a pressure chamber and leads ink from the outlet of the common ink chamber to a nozzle through the pressure chamber, wherein the common ink chamber and the individual ink flow path are formed of a plurality of metal thin plate members having holes formed thereon, the thin plate members being laminated and fixed onto one another by metal-metal junction, and wherein sectional area of the common ink chamber along a planar direction of the thin plate members is configured to be smaller at an end portion where the outlet is provided than at a central portion in a direction of thickness of the plurality of thin plate members.

2. The inkjet printing head according to claim 1, wherein the sectional area of the common ink chamber is configured to be larger at the other end portion opposite to the end portion than at the central portion.

3. The inkjet printing head according to claim 2, wherein each hole, formed on the plurality of thin plate members and forms the common ink chamber, is configured such that the size of each hole increases from the hole provided at the side of the outlet towards the opposite side of the common ink chamber.

4. The inkjet printing head according to claim 1, wherein the sectional area of the common ink chamber is configured to be changed stepwise in three or more stages at the end portion.

5. The inkjet printing head according to claim 1, wherein the sectional area of the common ink chamber is configured to be changed continuously at the end portion.

6. The inkjet printing head according to claim 1, wherein the common ink chamber is formed by the holes being connected to one another.

7. The inkjet printing head according to claim 1, wherein rate of change of the sectional area of the common ink chamber is configured to be larger at one side where the pressure chamber is disposed than at an opposite side positioned oppositely to the one side with respect to the outlet.

8. The inkjet printing head according to claim 1, wherein a thickest one of a part of the plurality of thin plate members that are laminated above the common ink chamber at a side to the pressure chamber, is positioned at a side to the common ink chamber in the part of the plurality of thin plate members with respect to a central position of the part of the plurality of thin plate members.

9. The inkjet printing head according to claim 8, wherein the thickest thin plate member serves as a roof of the common ink chamber.

10. The inkjet printing head according to claim 8, wherein the plurality of thin plate members include:

a cavity plate on which formed a hole corresponding to the pressure chamber;

a supply plate on which formed a hole corresponding to the outlet and configured to be the thickest thin plate member; and an aperture plate on which formed a hole corresponding to a restricted flow path that restricts flow of the ink and provided between the common ink chamber and the pressure chamber in the individual ink flow path, the aperture plate being laminated at a position between the cavity plate and the supply plate.

11. The inkjet printing head according to claim 8, wherein a plurality of the pressure chambers are arranged in a matrix, and wherein the common ink chamber is provided to extend in a direction along the pressure chambers and has a sectional shape in which a length in a direction of the lamination of the plurality of thin plate members is larger than a length in a direction perpendicular to the direction of extension thereof.

12. An inkjet printing head comprising:

a common ink chamber having an outlet; and an individual ink flow path having a pressure chamber and leads ink from the outlet of the common ink chamber to a nozzle through the pressure chamber, wherein the common ink chamber and the individual ink flow path are formed of a plurality of thin plate members having holes formed thereon, the thin plate members being laminated and fixed onto one another by metal-metal junction, and wherein a thickest one of a part of the plurality of thin plate members that are laminated above the common ink chamber at a side to the pressure chamber, is positioned at a side to the common ink chamber in the part of the plurality of thin plate members with respect to a central position of the part of the plurality of thin plate members.

13. The inkjet printing head according to claim 12, wherein the thickest thin plate member serves as a roof of the common ink chamber.

14. The inkjet printing head according to claim 12, wherein the plurality of thin plate members include:

a cavity plate on which formed a hole corresponding to the pressure chamber;

a supply plate on which formed a hole corresponding to the outlet and configured to be the thickest thin plate member; and an aperture plate on which formed a hole corresponding to a restricted flow path that restricts flow of the ink and provided between the common ink chamber and the pressure chamber in the individual ink flow path, the aperture plate being laminated at a position between the cavity plate and the supply plate.

15. The inkjet printing head according to claim 12, wherein a plurality of the pressure chambers are arranged in a matrix, and wherein the common ink chamber is provided to extend in a direction along the pressure chambers and has a sectional shape in which a length in a direction of the lamination of the plurality of thin plate members is larger than a length in a direction perpendicular to the direction of extension thereof.

* * * * *